US005858598A

United States Patent [19]

Nakayama

[11] Patent Number: 5,858,598

[45] Date of Patent: Jan. 12, 1999

[54] ELECTROPHOTOGRAPHIC TONER

[75] Inventor: Kojo Nakayama, Shizuoka, Japan

[73] Assignee: Tomoegawa Paper Co., Ltd., Tokyo, Japan

[21] Appl. No.: 941,757

[22] Filed: Sep. 30, 1997

Related U.S. Application Data

[62] Division of Ser. No. 590,476, Jan. 24, 1996, Pat. No. 5,753,397.

[30] Foreign Application Priority Data

Jan. 30, 1995 [JP] Japan ..... 7-31803
Feb. 3, 1995 [JP] Japan ..... 7-37825

[51] Int. Cl.[6] ..... G03G 9/097
[52] U.S. Cl. ..... 430/110; 430/109
[58] Field of Search ..... 430/110, 109

[56] References Cited

U.S. PATENT DOCUMENTS 5,314,777 5/1994 Watanabe et al. ..... 430/110
5,510,222 4/1996 Inaba et al. ..... 430/109
5,578,409 11/1996 Kotaki et al. ..... 430/109
5,587,265 12/1996 Nakadera et al. ..... 430/109
5,604,072 2/1997 Unno et al. ..... 430/110

FOREIGN PATENT DOCUMENTS 0 627 669 12/1994 European Pat. Off. ..... 430/109
61-285 461 12/1986 Japan ..... 430/110
63-241 563 10/1988 Japan ..... 430/110

OTHER PUBLICATIONS

*Neufeldt et al., Ed. Third College Edition Webster's New World Dictionary* (1988) p. 1572.

*Primary Examiner*—Janis L. Dote
*Attorney, Agent, or Firm*—Wenderoth, Lind & Ponack, L.L.P.

[57] ABSTRACT

An electrophotographic toner containing a binder resin containing an ester which has 2–4 ester bonds and is obtained from a long-chain, linear saturated alcohol as an alcohol component or a long-chain linear saturated fatty acid as an acid component, can be fixed at a low fixing temperature, is free of any practical problem concerning offset-free properties, and has excellent fixing strength to a receptor paper sheet and excellent image characteristics.

5 Claims, No Drawings

ELECTROPHOTOGRAPHIC TONER

This application is a division of application Ser. No. 08/590,476, filed Jan. 24, 1996, now issued U.S. Pat. No. 5,753,397.

FIELD OF THE INVENTION

The present invention relates to an electrophotographic toner. More specifically, it relates to an electrophotographic toner suitable for use with a copying machine and a printer for which a hot roll fixing is adapted.

DESCRIPTION OF PRIOR ART

In recent years, it is desired with the spreading use of a copying machine and a printer that the copying machine and the printer should comply with a decrease in energy (a decrease in electric power consumption) for mainly popularizing the use of them at home and attaining multi-functions, a fast performance for spreading the use of them to a so-called gray zone in a boundary of printers and copying machines, and a decrease in roll pressure for the simplification of a fixing roll in order to decrease the costs of them.

Further, as copying machines having the function of double-surface copying and an automatic document feeder are widely used with the availability of high-quality copying machines, electrophotographic toners are required to be excellent in the following properties. That is, electrophotographic toners are required to have a low fixing temperature and excellent resistance to offsetting, and they are also required to have fixing strength to a receptor sheet sufficient for the prevention of soiling at the time of double-surface copying and soiling of an automatic document feeder.

For complying with the above requirements, it has been hitherto proposed to improve toners in the molecular weight of binder resins contained in the toners and/or the molecular weight distribution of the binder resins.

Specifically, it has been attempted to decrease the molecular weight of a binder resin for decreasing the fixing temperature. The melting point of a toner can be decreased, while the viscosity of the toner decreases at the same time, which causes a problem in that a phenomenon of offsetting to a fixing roll takes place. It has been attempted to overcome the above offsetting phenomenon by a method in which the molecular weight distribution of a binder resin is broadened by adjusting the low molecular weight region and the high molecular weight region of the binder resin or by a method in which the binder resin in the high molecular weight region is crosslinked. In these methods, however, it is required to decrease the glass transition temperature (Tg) of the resin for obtaining a toner having sufficient fixing properties, and it is therefore inevitable to impair the shelf life of the toner. Further, when the content of a binder resin in the low molecular weight region is large, the toner itself is fragile, and a receptor sheet is soiled at the time of double-surface copying and the automatic document feeder is soiled.

Further, it has been also proposed to incorporate a polyolefin-containing releasing agent for preventing the above offsetting phenomenon. However, a toner containing a releasing agent has a high melting point, and has the following problem. When this toner is fixed at a low temperature, the fixing strength of the toner to a receptor sheet is not sufficiently high. It has been also proposed to incorporate a wax having a low melting point such as carnauba wax, rice wax or candelilla wax. Since, however, wax is a mixture of a plurality of esters, and free fatty acid or free alcohol remains this causes a problem on the shelf life of a toner when the wax is contained in the toner.

SUMMARY OF THE INVENTION

It is an object of the present invention to provide an electrophotographic toner which can be fixed at a low fixing temperature, which is free of any practical problem concerning offset-free properties, and which has excellent fixing strength to a receptor paper sheet and excellent image characteristics.

According to the present invention, there is provided an electrophotographic toner containing a binder resin containing an ester which has 2–4 ester bonds and is obtained from a long-chain, linear saturated alcohol as an alcohol component or a long-chain linear saturated fatty acid as an acid component.

According to the present invention, there is further provided an electrophotographic toner containing a binder resin containing a triester synthesized from a long-chain linear saturated alcohol and boric acid.

Further, according to the present invention, there is provided an electrophotographic toner containing a binder resin containing an ester which has 2–4 ester bonds and is synthesized from a long-chain linear saturated fatty acid, a neopentyl polyol and a dicarboxylic acid.

DETAILED DESCRIPTION OF THE INVENTION

The ester which has 2–4 ester bonds and is obtained from a long-chain, linear saturated alcohol as an alcohol component or a long-chain linear saturated fatty acid as an acid component, used in the present invention, includes a triester obtained from a long-chain linear saturated alcohol and boric acid.

The above boric acid includes boric anhydride, orthoboric acid, metaboric acid, tetraboric acid and boron trichloride. The above long-chain linear saturated alcohol includes $CH_3(CH_2)_{n-1}OH$ in which n is approximately 6–28. The triester is obtained, for example, by a method in which boric anhydride and a long-chain linear saturated alcohol are placed in a round-bottom flask having a stirrer and the mixture is generally allowed to react in an esterification reaction at least 120° C. In this case, the amount of the long-chain linear saturated alcohol per mole of the boric anhydride is 3 mol. Then, the reaction mixture is filtered, and the residue is purified with an alcohol or ether.

The ester which has 2–4 ester bonds and is synthesized from a long-chain linear saturated fatty acid, used in the present invention, includes a compound synthesized from a long-chain linear saturated fatty acid, a neopentyl polyol and a dicarboxylic acid.

The above neopentyl polyol includes neopentyl glycol, trimethylolpropane and pentaerythritol. Of these neopentyl polyols, pentaerythritol is the most preferred since the toner as an end product is excellent in a shelf life.

The above dicarboxylic acid includes aliphatic saturated dicarboxylic acids such as oxalic acid, malonic acid, succinic acid, glutaric acid, adipic acid, pimelic acid, suberic acid, azelaic acid and sebacic acid, aliphatic unsaturated dicarboxylic acids such as maleic acid and fumaric acid, and aromatic dicarboxylic acids such as phthalic acid, isophthalic acid and terephthalic acid. Of these dicarboxylic acids, short-chain aliphatic dicarboxylic acids such as oxalic acid, malonic acid, maleic acid and fumaric acid are preferred since the toner shows a decreased melting point and improved fixing properties.

The long-chain linear saturated fatty acid has the formula of $CH_3(CH_2)_nCOOH$ in which n is approximately 6–28. Specific examples of the long-chain linear saturated fatty acid include capric acid, undecylic acid, lauric acid, tridecylic acid, myristic acid, pentadecylic acid, palmitic acid, heptadecanoic acid, stearic acid, nonadecanoic acid, arachic acid, behenic acid, lignoceric acid, cerotic acid, heptacosanoic acid, montanic acid and melissic acid.

The amount of the dicarboxylic acid per mole of the long-chain linear saturated fatty acid is 0.3–0.8. When the amount of the dicarboxylic acid exceeds the above upper limit, undesirably, the melting point of the ester compound increases and the fixing properties of the toner at a low temperature are liable to be poor. When the above amount is smaller than the above lower limit, undesirably, the melting point of the toner is too low so that the storage stability of the toner is liable to be poor.

The above ester is obtained by a method in which the neopentyl polyol, the dicarboxylic acid and the long-chain linear saturated fatty acid are placed in a round-bottom flask having a stirrer and a condenser with a small amount of sulfuric acid, the mixture is refluxed under heat at about 130° C. for about 4 hours, the reaction mixture filtered, and the residue is purified with methyl ether.

The above ester having ester bonds preferably has a melting point of 40°–80° C. With a decrease in the above the melting point, the fixing properties at a low temperature is improved. However, when the melting point is lower than 40° C., the toner shows a poor shelf life. When the above melting point is higher than 80° C., undesirably, the toner shows poor fixing properties at a low temperature. The amount of the ester per 100 parts by weight of the binder resin (excluding the ester) is preferably 1–20 parts by weight. When the amount of the ester is less than 1 part by weight, there is no effect on the fixing properties. When the above amount is greater than 20 parts by weight, undesirably, the melting viscosity is so low that a high-temperature offsetting takes place.

In the present invention, the term "melting point" refers to the temperature at a heat absorption peak when the heat absorption is measured by DSC. Specifically, the heat absorption is measured by a method in which about 10 mg of an ester is weighed and set, for example, in a differential scanning calorimeter DSC-5200 supplied by Seiko Instruments Inc., $N_2$ gas is introduced at a rate of 50 ml/minute, the ester is temperature-increased from 20° C. to 150° C. at a rate of 10° C./minute and rapidly cooled from 150° C. to 20° C., and this temperature-increasing and cooling process is repeated once more. When a plurality of heat absorption peaks are observed, a temperature at which the greatest heat absorption is observed is taken as the melting point.

As the binder resin used in the present invention, any one of resins generally used as a binder resin for a toner may be used, while particularly preferred are those resins which have low melting initiation temperatures in view of an improvement in fixing performance. The toner preferably has a melting initiation temperature in the range of from 60° C. to 100° C. When the melting initiation temperature of the toner is higher than 100° C., the toner shows insufficient fixing properties. When it is lower than 60° C., the toner shows poor blocking properties to cause a problem in its shelf life.

The melting initiation temperature in the present invention refers to the temperature at which a plunger starts to move downward under the following measurement conditions.

Measuring apparatus: Koka type flow tester CF-500 supplied by Shimadzu Corporation Measurement conditions:

Plunger: 1 $cm^2$

Diameter of die: 1 mm

Length of die: 1 mm

Load: 20 kgF

Temperature for preliminary heating: 50°–80° C.

Time for preliminary heating: 300 seconds

Temperature elevation rate: 6° C./minute

The toner of the present invention is obtained by mixing the binder resin containing the above ester, a colorant, a charge control agent and optionally additive(s) such as a magnetic material in a mixing ratio as required, melt-kneading the mixture, cooling the kneaded product to solidness, pulverizing the resultant solid and classifying the pulverized product. Further, the toner of the present invention may be a so-called polymerization method toner obtained by mixing the above materials when the resin is polymerized.

The binder resin used in the present invention includes a styrene resin, a polyacrylic acid ester resin, a styrene-acrylate copolymer resin, polyvinyl chloride, polyvinyl acetate, polyvinylidene chloride, a phenolic resin, an epoxy resin and a polyester resin.

The colorant used in the present invention includes carbon black, nigrosine dye, Aniline Blue, Chalcooil Blue, Chromium Yellow, Ultramarine Blue, Du Pont Oil Red, Quinoline Yellow, Methylene Blue Chloride, Phthalocyanine Blue, Malachite Green Oxalate, lamp black and Rose Bengale. These colorants may be used alone or in combination. The colorant is required to be contained in an amount sufficient for forming visible images having a sufficient density. The amount of the colorant per 100 parts by weight of the binder resin (excluding the ester) is 1–20 parts by weight.

The magnetic material optionally used in the present invention includes ferrite, magnetite, ferromagnetic metals such as iron, cobalt and nickel, alloys of these metals, compounds containing these metals, alloys which contain no ferromagnetic metal but exhibit ferromagnetism when properly treated under heat, i.e., so-called Heusler alloys containing manganese and copper such as manganese-copper-aluminum alloy and manganese-copper-tin alloy, and chromium dioxide. The magnetic material is homogeneously incorporated into the binder resin in a state in which the magnetic material has the form of a fine powder having an average diameter of 0.1–1 $\mu$m. The content of the magnetic material, per 100 parts by weight of the toner (excluding the magnetic material) is 20–70 parts by weight, preferably 40–70 parts by weight. When the content of the magnetic material is less than 20% by weight, the magnetic power of the toner is insufficient for forming a magnetic brush, and there is a problem in forming an image. When the above content is greater than 70% by weight, undesirably, not only the magnetic power of the toner is so high that the image density is insufficient, but also the fixing properties are poor.

The electrophotographic toner of the present invention may be mixed with a carrier formed of a ferrite powder or an iron powder to form a two-component developer. Further, when the toner of the present invention contains the above magnetic material, the toner may be used as a one-component developer for developing an electrostatic image without mixing it with any carrier, or may be mixed with the above carrier to form a two-component developer. The toner of the present invention may be also applied to a non-magnetic one-component developing method.

The electrophotographic toner of the present invention contains a binder resin containing an ester which has 2–4 ester bonds and is obtained from a long-chain linear saturated alcohol as an alcohol component or a long-chain linear saturated fatty acid as an acid component.

The present invention provides an electrophotographic toner which has a melting initiation temperature far lower than the melting initiation temperature, i.e., about 110° C., of conventional toners. Further, differing from conventional toners, the electrophotographic toner of the present invention accomplishes both excellent low-temperature fixing properties and a wide offsetting-free temperature range. Therefore, the heat-fixing temperature can be set at a temperature far lower than those temperatures required of conventional toners, so that the electric power consumption of a copying machine or a printer can be greatly decreased.

EXAMPLES

The present invention will be explained with reference to Examples hereinafter, in which "part," stands for "part by weight".

Synthesis Example 1

(Synthesis of stearyl borate)

Boric anhydride in an amount of 1 mol and 3 mol of stearyl alcohol were placed in a round-bottom flask having a stirrer, and heated at 120° C. for 4 hours. The reaction mixture was filtered, and the residue was purified with methyl ether to give stearyl borate. This triester had a melting point of 55° C. as a temperature of heat absorption peak measured by DSC.

The above stearyl borate was used to prepare the following electrophotographic toners.

Example 1

| | |
|---|---|
| Styrene-acrylate copolymer resin A (monomer composition: styrene 85 parts by weight/butyl acrylate 15 parts by weight) | 100 parts |
| [Copolymer having a high molecular weight | |
| $Mw = 9.0 \times 10^5$ | |
| $Mn = 3.9 \times 10^5$ | |
| Copolymer having a low molecular weight | |
| $Mw = 8.0 \times 10^3$ | |
| $Mn = 2.7 \times 10^3$ | |
| Copolymer having a low molecular weight: copolymer having a low molecular weight = 70:30] | |
| Stearyl borate | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

The above materials were mixed with a super mixer, melt-kneaded and then pulverized with a jet mill, and the pulverized product was classified with a dry-method flush classifier to give negatively chargeable toner matrix particles having an average particle diameter of 11 $\mu$m. Then, 100 parts of the toner matrix particles and 0.3 part of hydrophobic silica (trade name: R-927, supplied by Nippon Aerosil) were stirred in a Henschel mixer for 1 minute to coat the individual particles with the hydrophobic silica, whereby an electrophotographic toner of the present invention was obtained.

Example 2

| | |
|---|---|
| The same styrene-acrylate copolymer resin A as that used in Example 1 | 100 parts |
| Stearyl borate | 10 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 1.

Synthesis Example 2

Eicosyl borate was obtained in the same manner as in Synthesis Example 2 except that the steary alcohol (long-chain linear saturated alcohol) was replaced with eicosyl alcohol. This ester had a melting point of 60° C. as a temperature of heat absorption peak measured by DSC.

The above eicosyl borate was used to prepare the following electrophotographic toners.

Example 3

| | |
|---|---|
| The same styrene-acrylate copolymor resin A as that used in Example 1 | 100 parts |
| Eicosyl borate | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 1.

Example 4

| | |
|---|---|
| The same styrene-acrylate copolymer resin A as that used in Example 1 | 100 parts |
| Eicosyl borate | 10 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 1.

Comparative Example 1

| | |
|---|---|
| The same styrene-acrylate copolymer resin A as that used in Example 1 | 100 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |

-continued

| | |
|---|---|
| Polypropylene (trade name: Viscol 330P, supplied by Sanyo Chemical Industries, Ltd.) | 3 parts |

A comparative electrophotographic toner was obtained from the above materials in the same manner as in Example 1.

Comparative Example 2

| | |
|---|---|
| The same styrene-acrylate copolymer resin A as that used in Example 1 | 100 parts |
| Castor wax | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

A comparative electrophotographic toner was obtained from the above materials in the same manner as in Example 1.

Comparative Example 3

| | |
|---|---|
| The same styrene-acrylate copolymer resin A as that used in Example 1 | 100 parts |
| Polyethylene wax (melting initiation tempetature 81.1° C.) | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

A comparative electrophotographic toner was obtained from the above materials in the same manner as in Example 1.

The above-obtained electrophotographic toners of the present invention and the above-obtained comparative electrophotographic toners were tested on the following items.

(1) Offsetting-free temperature range and offsetting-free temperature width

4 Parts of an electrophotographic toner sample or a comparative electrophotographic toner and 96 parts of an non-coated ferrite carrier (trade name: FL-1020, supplied by Powder Tech) were mixed to obtain a two-component developer. The two-component developer was used to form non-fixed toner images having a band form having a size of 2 cm×5 cm on a plurality of A4-size transfer sheet with a commercially available copying machine (trade name: SF-9800, supplied by Sharp Corp.).

Then, a fixing machine having a set of a heat fixing roll surface-coated with a fluorine resin (trade name: Teflon, supplied by du Pont de Nemours & Co.) and a pressure fixing roll having a surface formed of silicone rubber was adjusted to a roll pressure of 1 kg/cm$^2$ and a roll speed of 50 mm/sec, and while the surface temperature of the above heat fixing roll was changed stepwise, the above non-fixed toner images on the transfer sheets were fixed. Then, the transfer sheets were observed as to whether or not those portions other than the fixed images were soiled with the toner. The temperature range in which no soiling took place was taken as an offsetting-free region. Further, a difference between the highest temperature (upper limit) of the offsetting-free region and the lowest temperature (lower limit) thereof was taken as an offsetting-free temperature width.

(2) Fixing strength

The surface temperature of the heat fixing roll of the above fixing machine was set at 140° C., and the above non-fixed toner image on the transfer sheet was fixed. And, a cotton pad was rubbed against the fixed image, and a fixing strength was calculated on the basis of the following equation and used as an index for low-energy fixing properties. The image density was measured with a reflection densitometer RD-914 supplied by Macbeth.

Fixing strength (%)=(image density of fixed image after rubbing/image density of fixed image before rubbing)×100

(3) Melting initiation temperature

Measured according to the method specified in the present specification.

Table 1 shows the results.

The results in Table 1 show that the electrophotographic toners of the present invention have excellent fixing properties over the comparative electrophotographic toners.

TABLE 1

| | Ex.1 | Ex.2 | Ex.3 | Ex.4 | CEx.1 | CEx.2 | CEx.3 |
|---|---|---|---|---|---|---|---|
| Offsetting-free temperature range °C. | 120 ∓ 190 | 115 ∓ 180 | 120 ∓ 195 | 110 ∓ 175 | 140 ∓ 200 | 120 ∓ 200 | 125 ∓ 200 |
| Offsetting-free temperature width °C. | 70 | 65 | 75 | 65 | 60 | 80 | 75 |
| Fixing strength % | 92 | 98 | 90 | 99 | 65 | 77 | 75 |
| Melting initiation temperature °C. | 97 | 92 | 98 | 90 | 109 | 104 | 105 |

Ex. = Example, CEx. = Comparative Example

Synthesis Example 3

Pentaerythritol in an amount of 1 mol, 2 mol of stearic acid and 1 mol of maleic acid were placed in a round-bottom flask having a stirrer, and heated at 130° C. for 4 hours for condensation. The reaction mixture was filtered, and the residue was purified with methyl ether to give an ester A of the present invention. This ester A had a melting point of 60° C. as a temperature of heat absorption peak measured by DSC.

The above ester A was used to prepare the following electrophotographic toners.

Example 5

| | |
|---|---|
| The same styrene-acrylate copolymer resin A as that used in Example 1 | 100 parts |
| Ester A | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

The above materials were mixed with a super mixer, melt-kneaded and then pulverized with a jet mill, and the pulverized product was classified with a dry-method flush classifier to give negatively chargeable toner matrix particles having an average particle diameter of 11 μm. Then, 100 parts of the toner matrix particles and 0.3 part of hydrophobic silica (trade name: R-927, supplied by Nippon Aerosil) were stirred in a Henschel mixer for 1 minute to coat the individual particles with the hydrophobic silica, whereby an electrophotographic toner of the present invention was obtained.

Example 6

| | |
|---|---|
| The same styrene-acrylate copolymer resin A as that used in Example 1 | 100 parts |
| Ester A | 10 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 5.

Synthesis Example 4

An ester B was obtained in the same manner as in Synthesis Example 3 except that the stearic acid (long-chain linear saturated fatty acid) was replaced with lauric acid. This ester B had a melting point of 51° C. as a temperature of heat absorption peak measured by DSC.

The above ester B was used to prepare the following electrophotographic toners.

Example 7

| | |
|---|---|
| The same styrene-acrylate copolymer resin A as that used in Example 1 | 100 parts |
| Ester B | 5 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 5.

Example 8

| | |
|---|---|
| The same styrene-acrylate copolymer resin A as that used in Example 1 | 100 parts |
| Ester B | 10 parts |
| Carbon black (trade name: MA-100, supplied by Mitsubishi Kasei Corporation) | 6.5 parts |
| Chromium-containing metal dye (trade name: S-34, supplied by Orient Chemical Industries, Ltd.) | 2 parts |
| Polypropylene (trade name: Viscol 330P, supplied by Sanyo Chemical Industries, Ltd.) | 3 parts |

An electrophotographic toner of the present invention was obtained from the above materials in the same manner as in Example 5.

The above-obtained electrophotographic toners of the present invention were tested in the same manner as in Example 1.

Table 2 shows the results. For comparison, Table 2 also shows the results of Comparative Examples 1 to 3.

The results in Table 2 show that the electrophotographic toners of the present invention have excellent fixing properties over the comparative electrophotographic toners.

TABLE 2

| | Ex.5 | Ex.6 | Ex.7 | Ex.8 | CEx.1 | CEx.2 | CEx.3 |
|---|---|---|---|---|---|---|---|
| Offsetting-free temperature range °C. | 120 ∓ 195 | 115 ∓ 185 | 115 ∓ 190 | 110 ∓ 180 | 140 ∓ 200 | 120 ∓ 200 | 125 ∓ 200 |
| Offsetting-free temperature width °C. | 75 | 70 | 75 | 70 | 60 | 80 | 75 |
| Fixing strength % | 90 | 93 | 94 | 99 | 65 | 77 | 75 |
| Melting initiation temperature °C. | 98 | 95 | 95 | 91 | 109 | 104 | 105 |

Ex. = Example, CEx. = Comparative Example

What is claimed is:

1. An electrophotographic toner having a melting initiation temperature in the range of 60° C. to 100° C., said toner containing a binder resin and a compound which has 2–4 ester bonds and is obtained from a linear saturated fatty acid having 8 to 30 carbon atoms, a neopentyl polyol and a dicarboxylic acid as the main components of the compound, wherein the compound which has 2–4 ester bonds is present in the amount of 1 to 20 parts by weight, per 100 parts by weight of the binder resin exclusive of the compound which has 2–4 ester bonds.

2. An electrophotographic toner according to claim 1, wherein the neopentyl polyol is pentaerythritol.

3. An electrophotographic toner according to claim 1, wherein the dicarboxylic acid is at least one selected from the group consisting of oxalic acid, malonic acid, maleic acid and fumaric acid.

4. An electrophotographic toner according to claim 1, wherein the compound which has 2–4 ester bonds is a compound obtained by using the dicarboxylic acid in an amount of 0.3 to 0.8 mol per mole of the linear saturated fatty acid.

5. An electrophotographic toner according to claim 1, wherein the compound which has 2–4 ester bonds has a melting point of 40° C. to 80° C.

* * * * *